US005893065A

United States Patent [19]

Fukuchi

[11] Patent Number: 5,893,065

[45] Date of Patent: Apr. 6, 1999

[54] APPARATUS FOR COMPRESSING AUDIO DATA

[75] Inventor: Hiroyuki Fukuchi, Sagamihara, Japan

[73] Assignee: Nippon Steel Corporation, Tokyo, Japan

[21] Appl. No.: 511,449

[22] Filed: Aug. 4, 1995

[30] Foreign Application Priority Data

Aug. 5, 1994 [JP] Japan ..... 6-204449
Aug. 5, 1994 [JP] Japan ..... 6-204450

[51] Int. Cl.[6] ..... G10L 7/00

[52] U.S. Cl. ..... 704/500; 704/229; 704/503

[58] Field of Search ..... 704/500, 229, 704/501, 502, 503, 504

[56] References Cited

U.S. PATENT DOCUMENTS

| | | | |
|---|---|---|---|
| 4,455,649 | 6/1984 | Esteban | 370/80 |
| 4,516,258 | 5/1985 | Ching et al. | 381/31 |
| 5,115,240 | 5/1992 | Fujiwara et al. | 341/51 |
| 5,502,789 | 3/1996 | Akagiri | 704/204 |
| 5,548,574 | 8/1996 | Shimoyoshi | 369/24 |
| 5,568,495 | 10/1996 | Laczko | 371/471 |
| 5,703,889 | 11/1994 | Shimoda | 371/55 |

FOREIGN PATENT DOCUMENTS

| | | |
|---|---|---|
| 5-037395 | 7/1991 | Japan . |
| 5-19798 | 7/1991 | Japan . |
| 4-250722 | 9/1992 | Japan . |

OTHER PUBLICATIONS

ISO/IEC 11172–3, 1993 Information Technology–Coding of Moving Picture and Associated Audio For Digital Storage Media At Up to 1.5 Mbit/s Annex C. pp. 66, 70–72.

*Primary Examiner*—David R. Hudspeth
*Assistant Examiner*—Daniel Abebe
*Attorney, Agent, or Firm*—Pollock, Vande Sande & Amernick

[57] ABSTRACT

An apparatus for compressing audio data is provided. An audio signal is sampled and divided into divided audio signals in a plurality of frequency bands. A predetermined process is applied to ones respective of the divided audio signals and a characteristic value for each of the divided audio signals is calculated after the predetermined process. An adaptive bit allocation circuit repeatedly allocates a number of bits to each of the divided audio signals based on the characteristic value and a bit rate of the input audio signal. The adaptive bit allocation circuit detects the frequency band containing one of the divided audio signals having a maximum characteristic value within a selected frequency range. A unit number of bits is repeatedly allocated to the one of the divided audio signals and the characteristics value is modified based on the unit number of bits. A counting member counts the number of allocated bits for the one of the divided audio signals. A detection range control member selects the frequency range used in the detection process in accordance with the bit rate of the input audio signal and the number of allocated bits that have been counted.

6 Claims, 8 Drawing Sheets

SAMPLING HOLD CIRCUIT
FILTER BANK CIRCUIT
FLOATING CIRCUIT
FLOATING CIRCUIT
FLOATING CIRCUIT
FLOATING CIRCUIT
QUANTIZATION CIRCUIT
QUANTIZATION CIRCUIT
QUANTIZATION CIRCUIT
QUANTIZATION CIRCUIT
SIGNAL CHARACTERISTIC CALCULATION CIRCUIT
ADAPTIVE BIT ALLOCATION CIRCUIT
FLOATING SIGNAL
BIT LENGTH SIGNAL
BIT RATE SIGNAL
20
21
22
23
24
25
26
27
28
29
30
31
40
41
42
43
44
45
12
11
48
61

APPARATUS FOR COMPRESSING AUDIO DATA

BACKGROUND OF THE INVENTION

1. Field of The Invention

The present invention relates to an apparatus for compressing audio data to be used for data compression in an audio data compression/decompression system for compressing the audio data for transmission or recording and decompressing the audio data for reproducing the transmitted or recorded data, and more particularly to a high efficiency encoding apparatus for compressing the audio data at a high compression factor and a high efficiency.

2. Description of The Related Art

Prior art references related to the present invention are:

Document 1: JP-A-4-250722

Document 2: JP-A-5-19798

Document 3: JP-A-5-37395

Document 4: ISO/IEC 11172-3, 1993 Information Technology-Coding of moving picture and associated audio for digital storage media at up to 1.5 Mbit/s, Annex C, p.p.66, 70–72

Various methods for efficiently coding (data compressing) an audio signal are known such as those disclosed in the above Documents 2 and 4. One example is a band division coding system (sub-band coding system) which divides a digital audio signal into a plurality of frequency bands for coding.

In the band division coding system, an input digital audio signal is sampled at a predetermined sampling period and the following band division coding is applied to the audio signal sampled in each sampling period. First, the sampled audio signal is transformed into audio signals of a plurality of frequency bands by a filter bank circuit and the signals contained in the respective frequency bands are subjected to floating by a floating process circuit. The floating process is a process to modify levels of signals contained in each frequency band by using a common coefficient to raise precision in a subsequent quantization process. For example, a process to normalize the signals contained in each frequency band based on a maximum absolute value therein may be used as the floating process. The common coefficient used in the modification in the floating process, or the signal used as a reference of the normalization when the normalization is used as the floating process is referred to as a floating coefficient.

The input audio signal is applied to a signal characteristic calculation circuit for determining its signal characteristic. An allocated bit-number, i.e. the number of bits to be used for representing the audio signals contained in each frequency band, is determined based on the signal characteristic and a predetermined number of bits per unit time i.e. a predetermined bit rate, which is separately inputted, to be used for representing the compressed audio signal.

A quantization circuit provided for each frequency band quantizes the audio signal, after the floating process, contained in the frequency band based on the allocated bit-number as determined for the frequency band thereby to output encoded data. In this manner, the encoded data of the audio signal contained in each frequency band is produced.

The signal characteristic calculation circuit and the adaptive bit allocation circuit have been known as disclosed in, for example, the above Documents 1 and 3. To fully understand the present invention, some explanation is added below. First, a circuit configuration of a prior art adaptive bit allocation circuit is explained with reference to FIG. 7. The adaptive bit allocation circuit allocates the number of bits to be used to represent the compressed audio signal to each band so as to enhance a signal-to-noise ratio (S/N ratio) of the audio signal contained in each band or to reduce the noise level.

As shown in FIG. 7, the adaptive bit allocation circuit includes a memory circuit 1, a maximum value detection circuit 2, a bit distribution circuit 4 and a signal-to-noise ratio modification circuit 5. The signal characteristic determined by the signal characteristic calculation circuit, or for example, a signal representing a magnitude of a signal energy of the audio signal contained in each frequency band is applied to a terminal 61 and stored in the memory circuit 1.

The maximum value detection circuit 2 detects a maximum of the energy values of the audio signals contained in all the bands stored in the memory circuit 1 to determine the band which contains the maximum. The bit distribution circuit 4 allocates a unit bit to the band containing the maximum. Namely, it increments the number of bits to be used to represent the audio signal contained in the band containing the maximum by the unit bit, for example, one bit. Each band is initially allocated with "0", for example, as the number of bits to represent the audio signal contained therein. Then, the signal-to-noise ratio modification circuit 5 calculates a modified value corresponding to the enhancement of the signal-to-noise ratio by the increment of the unit bit and modifies the energy value, as stored in the memory circuit, of the audio signal contained in the band containing the maximum by the modified value. The modified value corresponding to the enhancement of the signal-to-noise ratio (S/N ratio) is a modified value based on the decrease of a relative noise due to the increment of the number of bits to represent the audio signal by one bit and it is calculated by a predetermined formula. A specific method for determining the modified value is well known and the explanation thereof is omitted.

In the bit distribution circuit 2, the total number of bits distributed to the audio signals contained in each band is checked, and if it is within a range of the bit rate indicated by the bit rate signal applied to the input terminal 11, the detection of the band containing the maximum is further repeated and the distribution of the unit bit is continued. In this manner, the bit length to be used to represent the audio signal contained in each band is determined by the total number of bits distributed to the band and it is outputted from the terminal 12.

The signal characteristic determined by the signal characteristic calculation circuit may be the magnitude of the energy for each band. Alternatively, an allowable noise spectrum for each band may be used by utilizing an audible masking effect. A prior art configuration therefor is explained with reference to FIG. 8.

The masking effect refers to a phenomenon in which certain sound is masked by other sound by the human auditory characteristic so that it is not audible by the human. The masking effect includes a temporal masking effect in which the masking occurs by signals which are close on a time axis and a simultaneous time masking effect in which the masking occurs by signals which are close on a frequency axis.

Even if a noise is contained in the masked portion, the noise is not audible by the masking effect. Thus, the noise within the range which is masked in the actual audio signal is considered as being permissible.

As shown in FIG. 8, the digital input data is applied through an input terminal 48 to the energy calculation circuit 51 for calculating the energy for each band. In the energy calculation circuit 51, the data is divided into a plurality of frequency bands in the same manner as in the filter bank circuit and the energy for each band is calculated based on the audio signal contained in each band by, for example, calculating the root-mean-square value of the amplitude.

A peak amplitude may be used instead of the energy. Alternatively, the signal representing the floating coefficient 46 may be used for this purpose.

Then, in the subtraction circuit 56, an absolute threshold, which corresponds to the minimum human auditory characteristic and is output from a minimum auditory characteristic table circuit 52, is subtracted from the signal energy of each band outputted from the energy calculation circuit 51.

In a masking effect modification circuit 57 in a stage following the subtraction circuit 56, the masking effect is modified for the permissible noise spectrum. The masking effect is modified by subtracting the permissible noise spectrum from the signal energy. The resulting characteristic signal is outputted to the adaptive bit allocation circuit through an output terminal 61.

FIG. 6 shows an example of the energy of the band, the absolute threshold and the masking threshold. In FIG. 6, the band is divided into 18. The energy at a certain time of each band calculated by the energy calculation circuit of FIG. 8 has a distribution pattern as shown by "E" in FIG. 6.

The absolute threshold which represents the human auditory characteristic has a distribution pattern which is high at a high frequency and also at a low frequency as shown by AS. The subtraction circuit 56 produces a difference between the energy E and the absolute threshold AS. The masking threshold by the masking effect is calculated by the masking characteristic calculation circuit 53 and has a distribution pattern as shown by MS in FIG. 6.

The masking effect appears at an area which is closer to a peak of the spectrum. By taking its affect into consideration, the masking effect modification circuit 57 of FIG. 8 modifies the permissible noise spectrum AS by MS and the bit allocation is carried out by utilizing the resulting permissible noise level AS+MS. The circuit parts constituting the signal characteristic calculation circuit of FIG. 8 are known and detailed description thereof is omitted.

In the prior art audio data compression apparatus, the amounts of calculation in the filter bank process, the floating process, the quantization process and the signal characteristic calculation process are substantially constant independent of the bit rate.

However, in the distribution of the bits to each band, the number of bits to be handled is larger and the amount of calculation is larger as the bit rate higher. As a result, the larger the bit rate is, the longer the processing time of the compression of the entire audio data compression apparatus is.

Further, the method of calculating the permissible noise spectrum by using the signal characteristic calculation circuit of FIG. 8 involves a problem such that although a high quality of sound is attained by utilizing the human auditory characteristic, the calculation of the permissible noise spectrum requires a large amount of calculation independent of the bit rate.

SUMMARY OF THE INVENTION

It is an object of the present invention to provide an apparatus for compressing audio data which can suppress the undue increase of the processing time when the bit rate to be used for the quantization of the audio data is high.

According to one aspect of the present invention, the apparatus for compressing audio data comprises means for sampling an input digital audio signal at a predetermined sampling period and transforming the sampled digital audio signal into a plurality of frequency band signals. Means are provided for each of the frequency band signals for applying a predetermined process to the audio signal contained in the corresponding band. A circuit for calculating a signal characteristic for each of the audio signals contained in each of the frequency bands, and an adaptive bit allocation circuit for allocating bits to be used to represent each of the processed audio signals contained in each of the frequency bands based on a predetermined bit rate are provided. The adaptive bit allocation circuit includes means for detecting one of the frequency bands containing one of the audio signals having a maximum characteristic value when the audio signals are represented by particular characteristic values, means for allocating a unit bit to each audio signal contained in the one frequency band, means for modifying the audio signal contained in the one frequency band, means for repeatedly activating the means for detecting one of the frequency bands, the means for allocating a unit bit and the means for modifying the audio signal based on the modified audio signal, count means for counting the number of times of repetition by the means for repeatedly activating, and means for controlling a band range of detection by the means for detecting one of the frequency bands based on the count of the count means.

In a preferred embodiment of the present invention, the signal characteristic calculation circuit includes a first circuit for calculating the signal characteristic in accordance with a first predetermined process, a second circuit for calculating the signal characteristic in accordance with a second predetermined process and switching means for selectively activating the first circuit and the second circuit in accordance with a bit rate.

According to another aspect of the present invention, the apparatus for compressing audio data comprises means for sampling an input digital audio signal at a predetermined sampling period and transforming the sampled digital audio signal into audio signals of a plurality of frequency bands. Means provided for each of the frequency bands for applying a predetermined process to the audio signal contained in the corresponding band, means for calculating a signal characteristic for each of the audio signals contained in each of the frequency bands, and an adaptive bit allocation circuit for allocating bits to be used to represent each of the processed audio signals contained in each of the frequency band based on a predetermined bit rate are provided. The signal characteristic calculation circuit includes a first circuit for calculating the signal characteristic in accordance with a first predetermined process, a second circuit for calculating the signal characteristic in accordance with a second predetermined process and switching means for selectively activating the first circuit and the second circuit in accordance with the bit rate.

DESCRIPTION OF THE PREFERRED EMBODIMENTS

Figure 1:
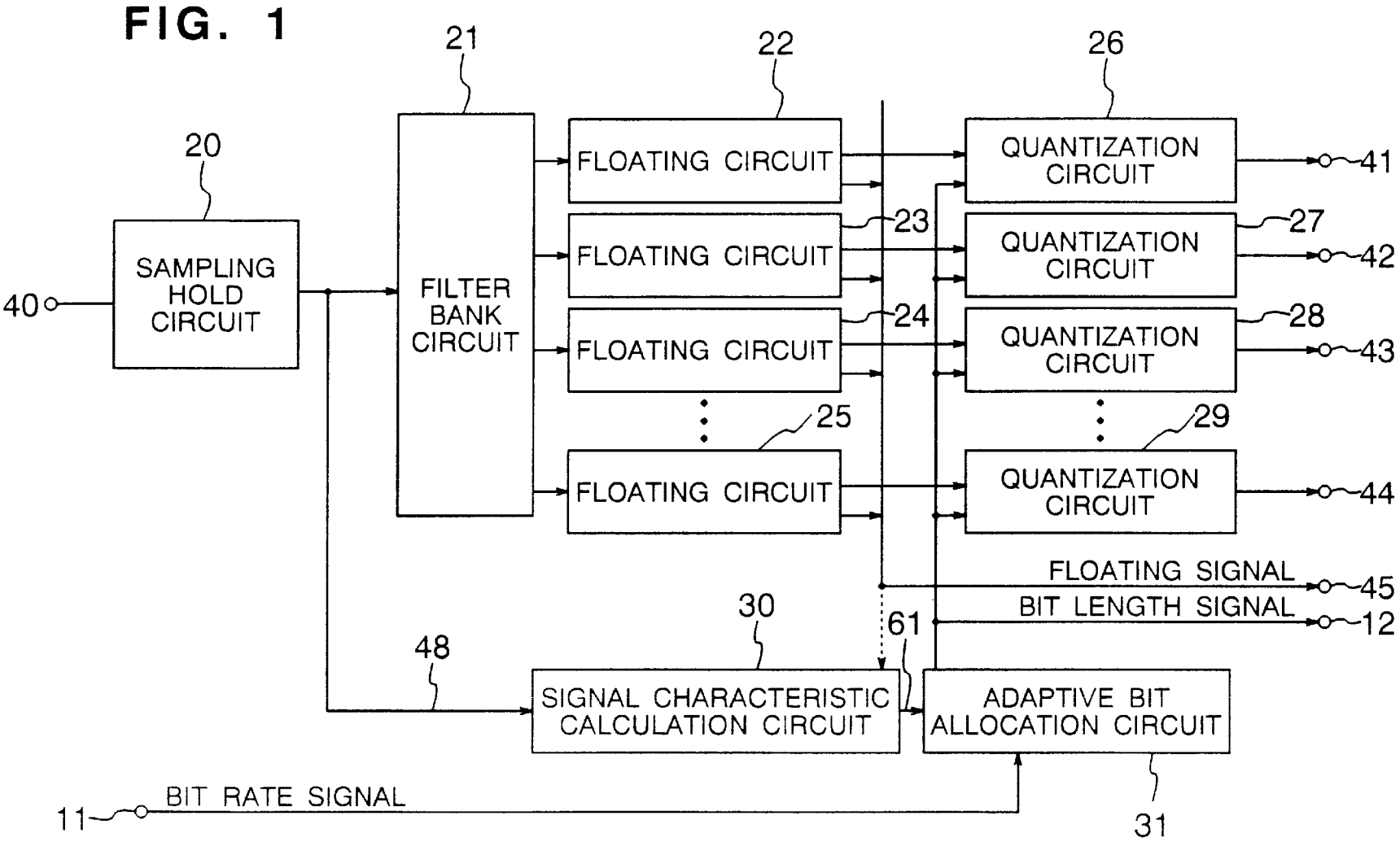
FIG. 1 shows a block diagram of a configuration of an apparatus for compressing audio data in accordance with one embodiment of the present invention.
Figure 2:
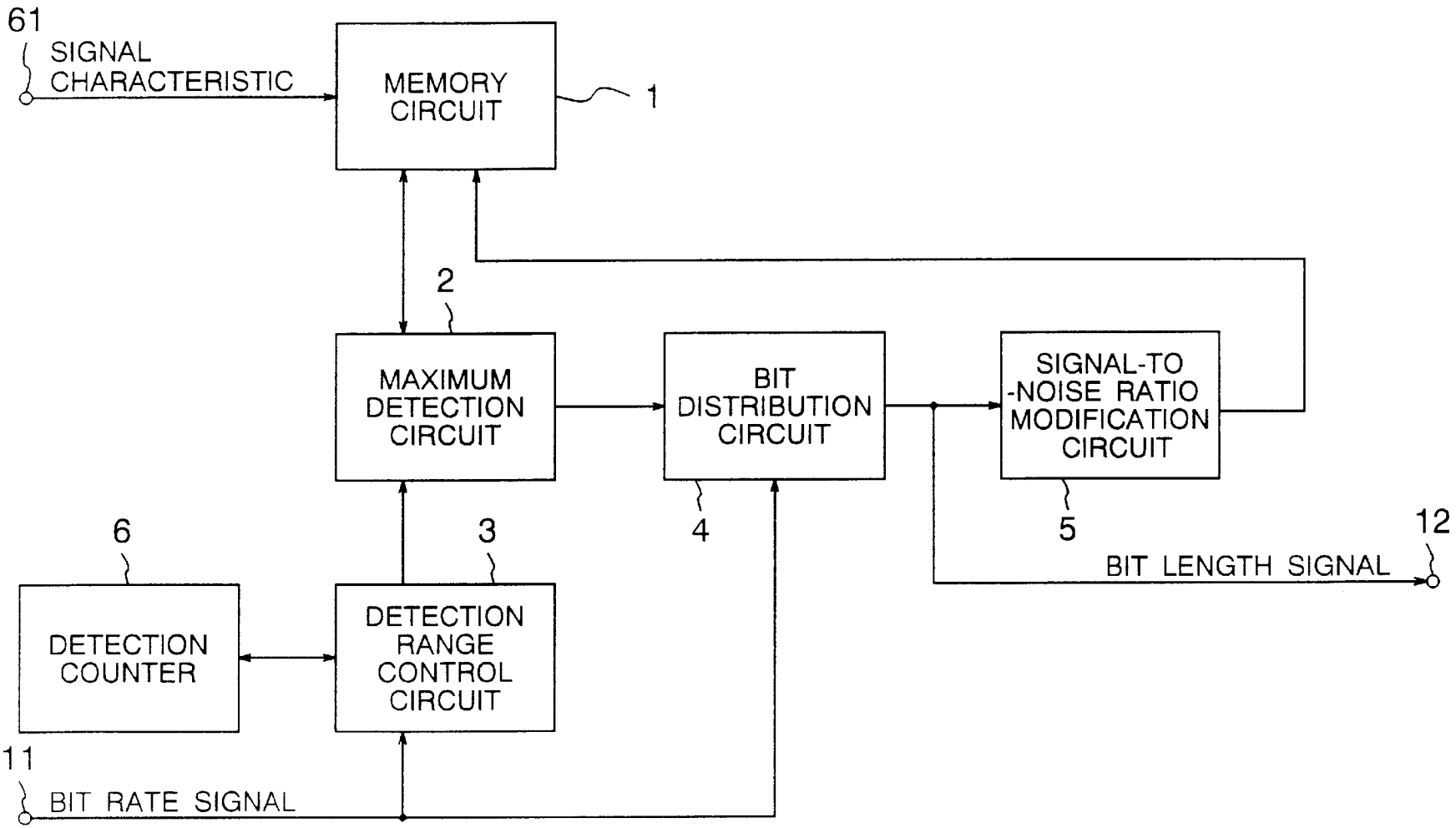
FIG. 2 shows a block diagram of a configuration of an adaptive bit allocation device used in the apparatus for compressing the audio data shown in FIG. 1.
Figure 3:
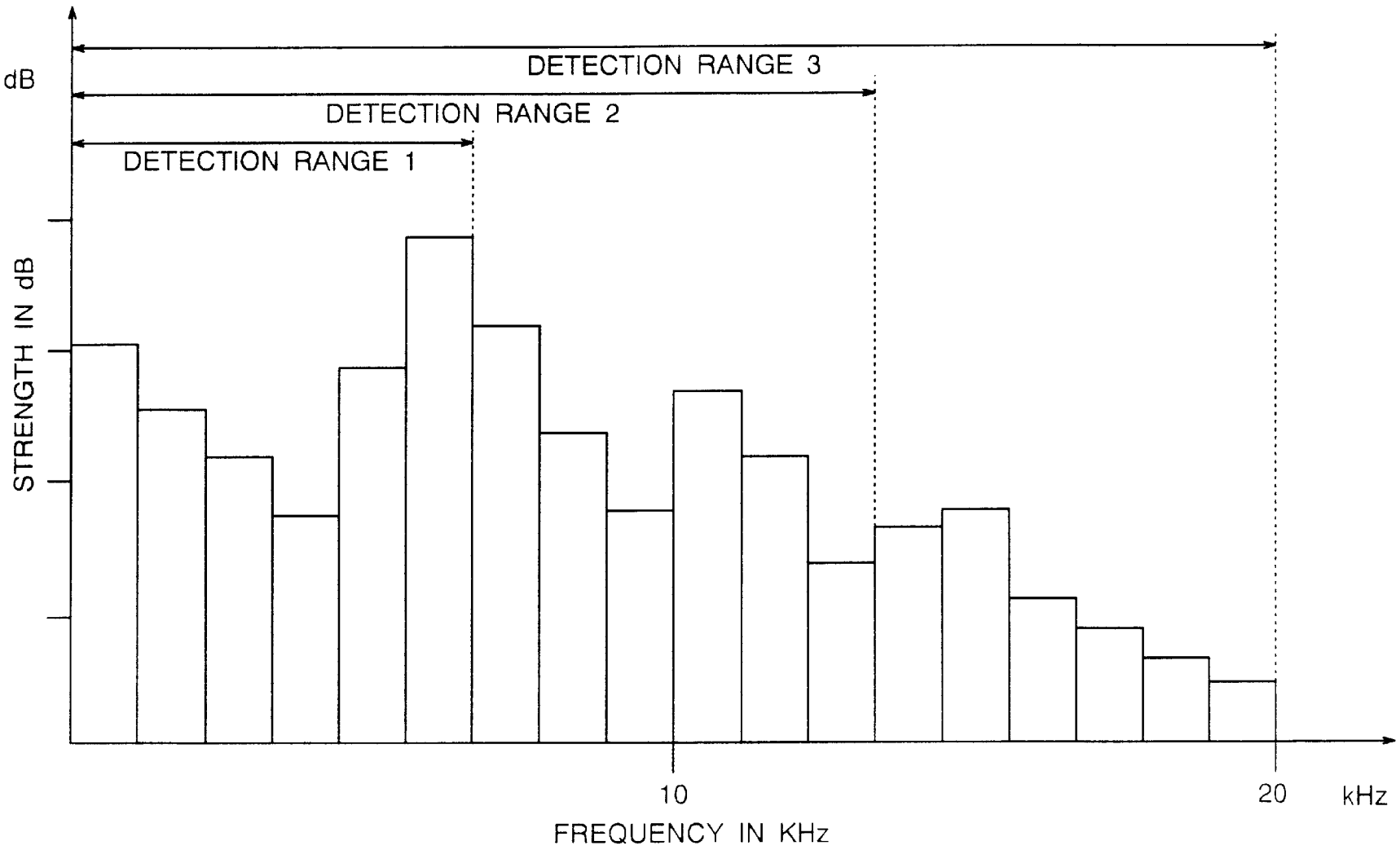
FIG. 3 shows an example of energy distribution in each frequency band and a search wavelength range in the adaptive bit allocation device.

Referring to FIGS. 1 to 3, a high efficiency coding apparatus which is an apparatus for compressing audio data in accordance with a first embodiment of the present invention is explained. The high efficiency coding apparatus of the present embodiment is constructed to efficiently encode a digital input signal such as an audio PCM signal by using technologies of band division coding, quantization and adaptive bit allocation.

As shown in FIG. 1, the audio digital signal is sampled by a sampling hold circuit 20 at a predetermined sampling period, and the sampled audio signal is transformed into audio signals of a plurality of frequency bands (for example, 32 bands) by a filter bank circuit 21 to form frequency bands or blocks divided in time and frequency.

For each block, the floating process is conducted by floating circuits 22, 23, 24 and 25 and the efficient coding is effected by using the adaptively allocated number of bits determined by an adaptive bit allocation circuit 31 based on a signal characteristic calculated by a signal characteristic calculation circuit 30 as will be described later.

The signal characteristic calculation circuit determines a signal energy, for example. The adaptive bit allocation circuit determines the number of bits to be allocated to each block by using the output of the signal characteristic calculation circuit. The quantization circuit quantizes the data after the floating process based on the allocated number of bits.

The quantized data is outputted through output terminals 22, 23, 24 and 25. A signal representing a floating coefficient, which indicates what reference is used for normalization of the signal, and a signal representing a bit length, which indicates the bit length used for quantization, are outputted along with the quantized data for use in the decompression of the compressed signal.

The determined bit length signals are outputted to quantization circuits 26, 27, 28 and 29, respectively. The quantization circuits 26~29 quantize with the adaptive bit length for each band and the coded data are outputted from output terminals 41, 41, 43 and 44.

The signal representing the floating coefficient and the signal representing the bit length are outputted from output terminals 45 and 12 together with the encoded data. The magnitude of energy of the signal in each band is used as the signal characteristic as will be described later.

In the first embodiment, all circuits excluding the adaptive bit allocation circuit are known and the detailed description thereof is omitted.

Referring to FIG. 2, a specific configuration of the adaptive bit allocation circuit is now explained.

The output of the signal characteristic calculation circuit, for example, the signal energy of each band is applied to an input terminal 61 of the adaptive bit allocation circuit and it is stored in a memory circuit 1. A maximum detection circuit detects a maximum of the energy values of the respective bands in the memory circuit 1 to determine the band containing the maximum. A bit distribution circuit 4 distributes a unit bit to the band containing the maximum.

A signal-to-noise ratio modification circuit 5 calculates a modified value corresponding to the enhancement of the signal-to-noise ratio due to the bit distribution and modifies the corresponding energy value in the memory circuit 1. The bit distribution circuit 4 checks a bit rate inputted through the input terminal 11 and the number of distributed bits. When the number of distributed bits is within the bit rate, the data detection is further conducted to continue the bit distribution. A signal representing the distributed bit length is outputted from an output terminal 12.

In the maximum detection, a detection range control circuit 3 controls the range of detection based on the signal representing the bit rate applied through the input terminal 11 and an output of the detection count circuit 6, e.g., counting means.

In the adaptive bit allocation process, as the bit rate becomes higher, the amount of bits to be handled becomes larger and the processing time becomes longer. During the adaptive bit allocation process, the longest time is spent for the detection of the maximum. Thus, the processing time is shortened by changing the detection of the maximum depending on the bit rate.

One example of the method of controlling the detection range will be explained with reference to a case where the inputted energy levels for the respective bands have characteristics as shown in FIG. 3. The frequency is divided into 18 bands in FIG. 3.

For example, when the bit rate is less than 320 KBPS, the detection range covers all the bands shown by "detection range 3" in FIG. 3. On the other hand, when the bit rate is equal to or larger than 320 KPBS, the detection range covers only lower six bands as shown by "detection range 1" in FIG. 3, if the number of times in repetition of the detection is less than 50.

If the number of times in repetition of the detection is equal to or larger than 50 and less than 100, the detection range covers lower 12 bands as shown by "detection range 2" in FIG. 3, while if the number of times in repetition of the detection is equal to or larger 100, the detection range covers all the bands as shown by "detection range 3" in FIG. 3. By narrowing the detection range, the time for the detection process may be shortened. In the above example, the bit allocation process can be reduced by approximately 25% when the bit rate is 320 KBPS.

Since the signal characteristic of the audio signal tends to concentrate in a range of lower and intermediate bands, when the bit rate is high, this tendency is utilized to collectively distribute the bits to the lower and intermediate bands so that the bit allocation by the above detection method may be attained without adverse effect to the sound quality.

As seen from the above description, in the adaptive bit allocation circuit of the present embodiment, the detection range of the characteristic level of the signal to be used for the bit allocation of the input digital signal is changed in accordance with the bit rate and the number of times in repetition of the detection so that the bit distribution is conducted at high speed.

Accordingly, in the apparatus for compressing the audio data which uses the adaptive bit allocation circuit as abovementioned, the range for detection of the characteristic level of the signal to be used for the bit allocation to the digital input signal is changed in accordance with the bit rate and the number of times in repetition of detection so that the bit distribution is conducted at a high speed and the amount of calculation is reduced, and the communication cost is reduced.

Figure 4:
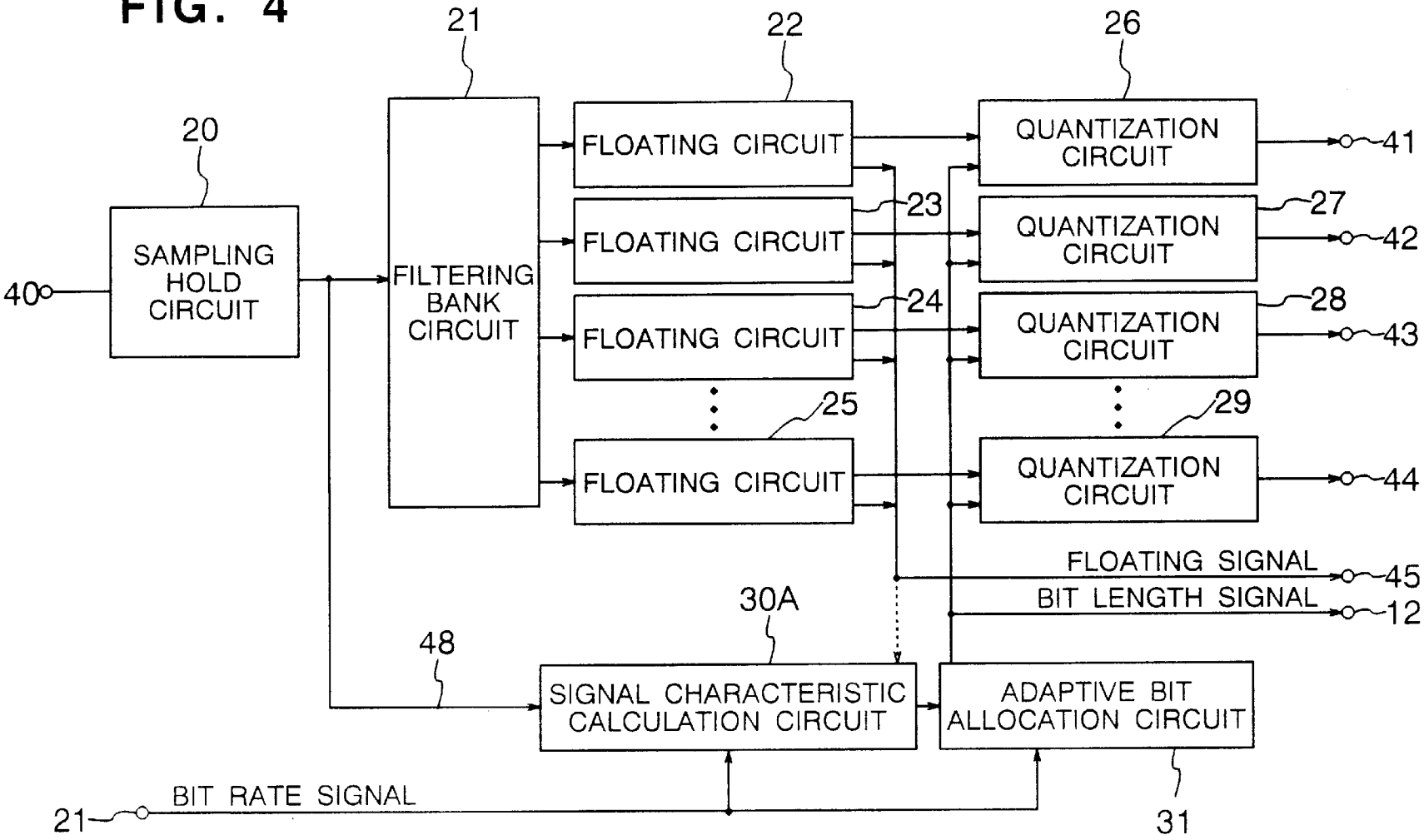
FIG. 4 shows a block diagram of a configuration of the apparatus for compressing the audio data in accordance with a second embodiment of the present invention.
Figure 5:
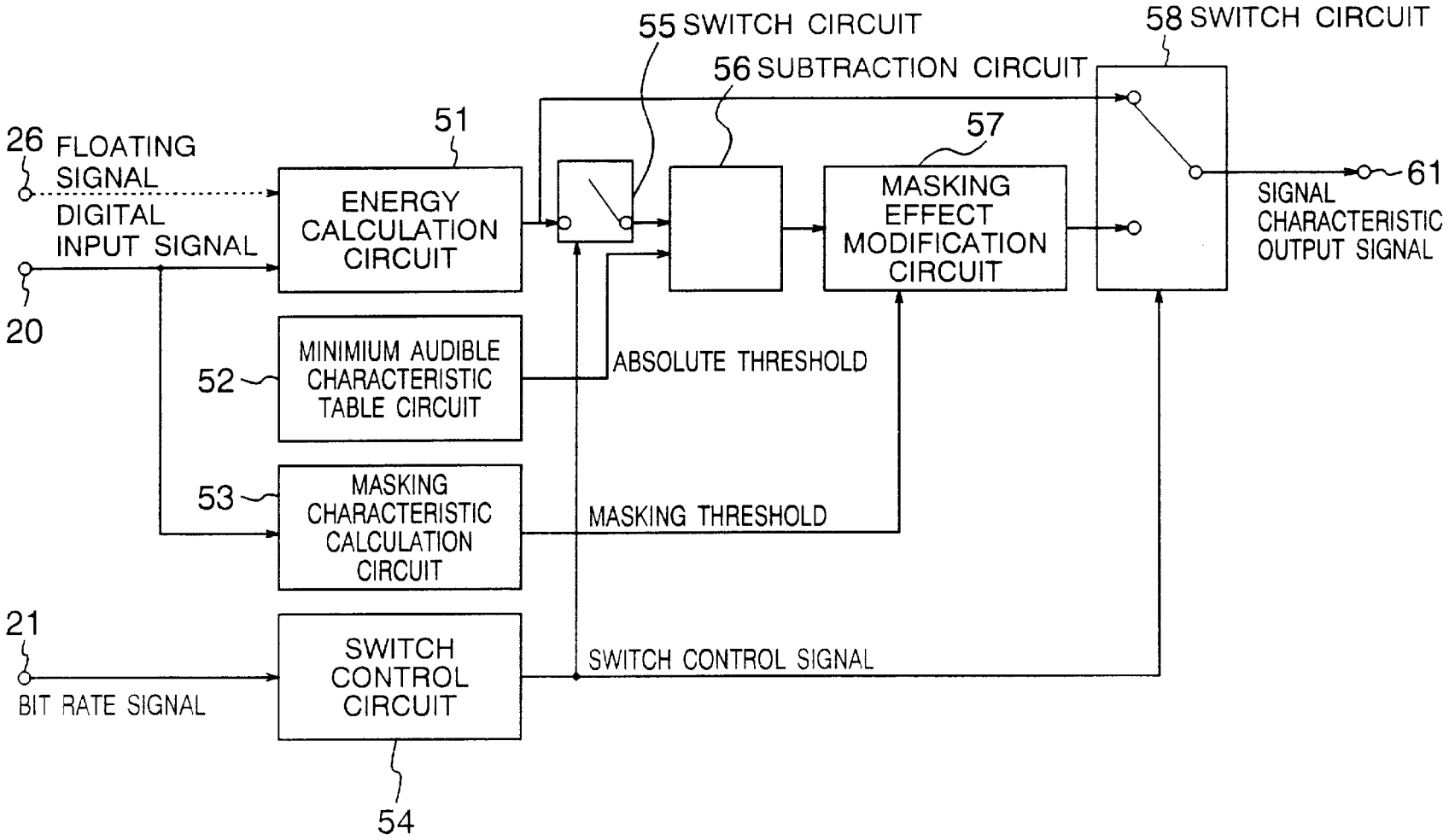
FIG. 5 shows a block diagram of a configuration of a signal characteristic calculation circuit used in the apparatus for compressing the audio data of FIG. 2.
Figure 6:
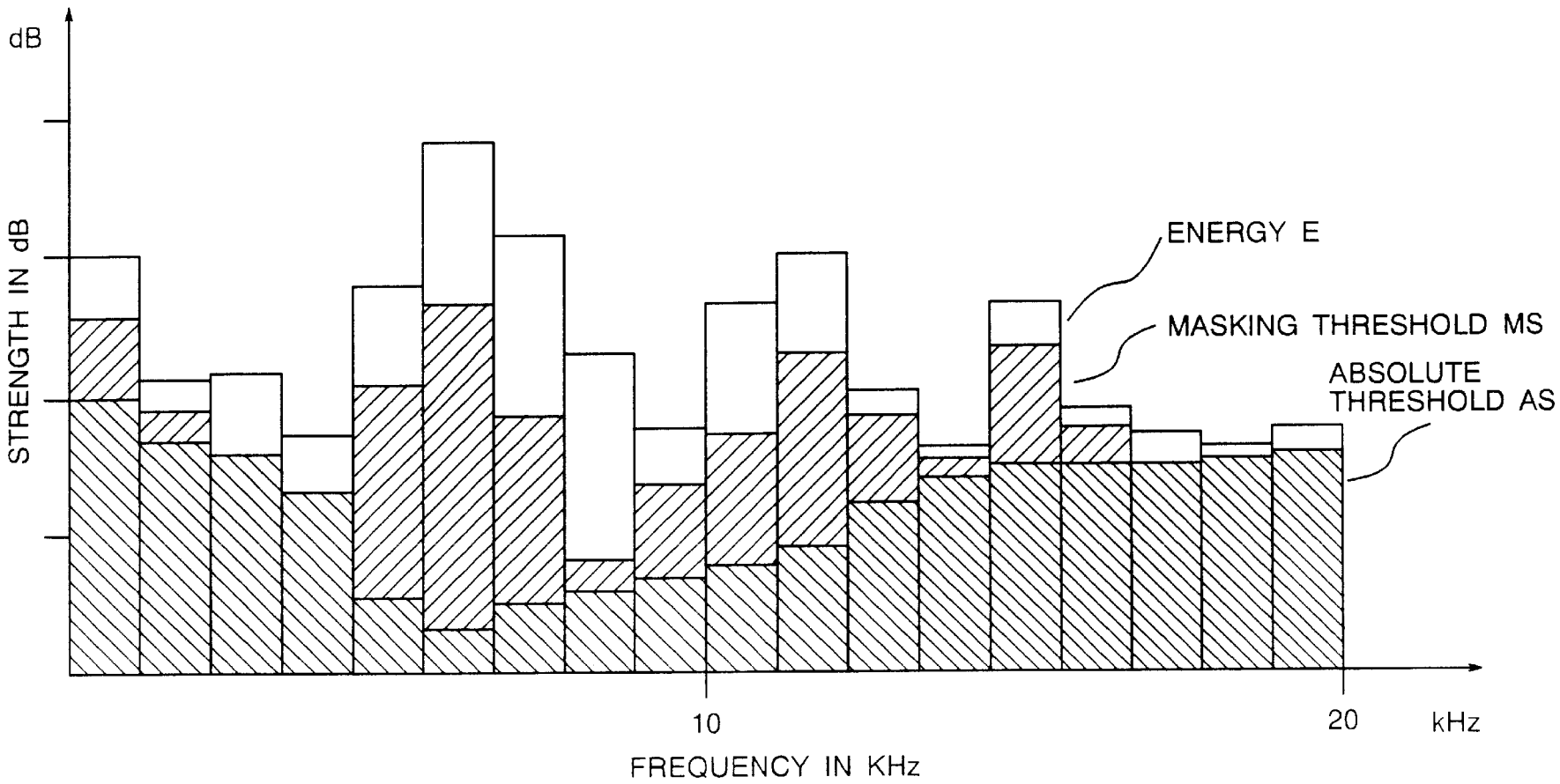
FIG. 6 shows an example of energy, absolute threshold and masking threshold in each frequency band.
Figure 7:
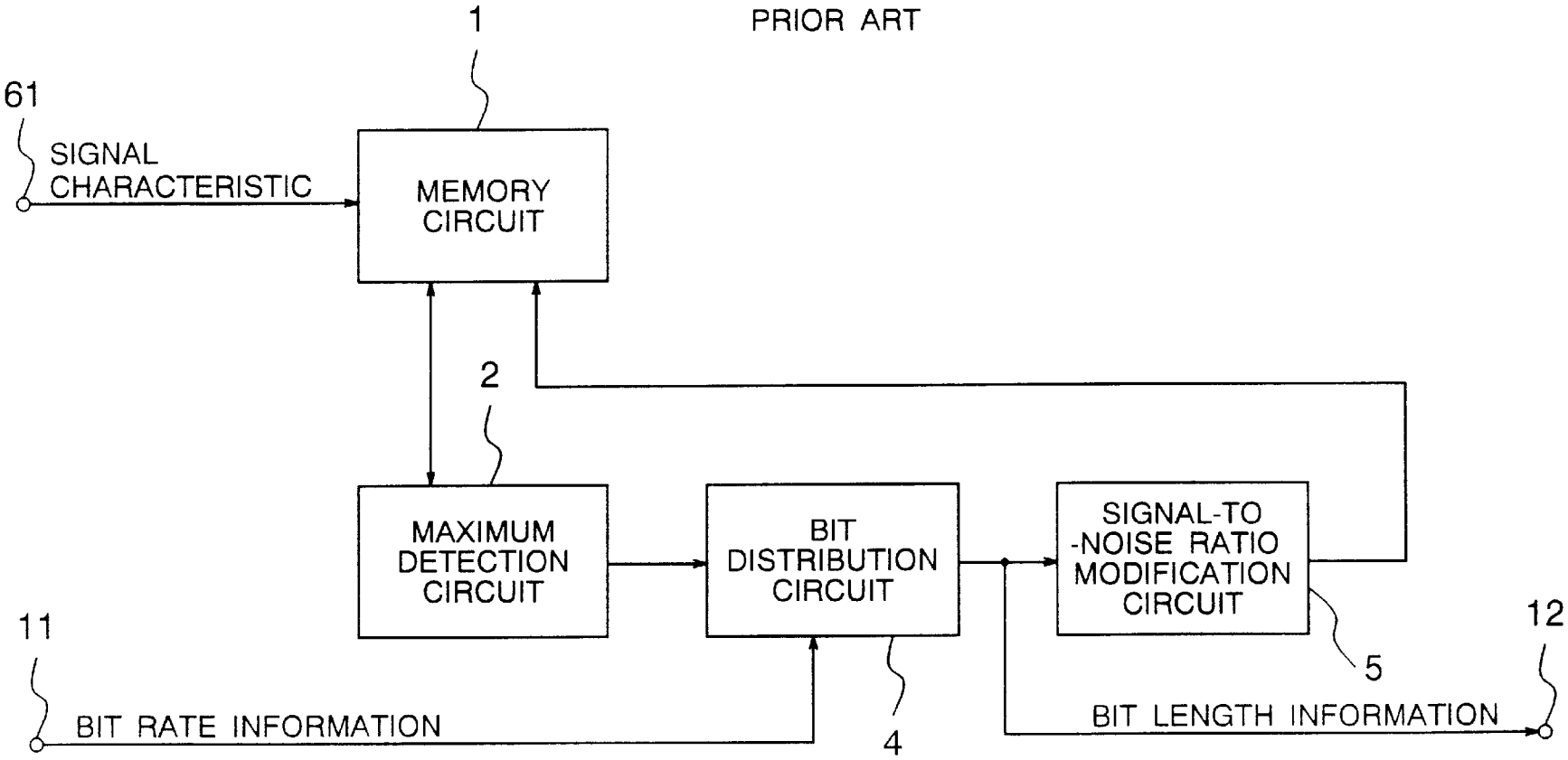
FIG. 7 PRIOR ART
FIG. 7 shows a block diagram of a configuration of a prior art adaptive bit allocation device.
Figure 8:
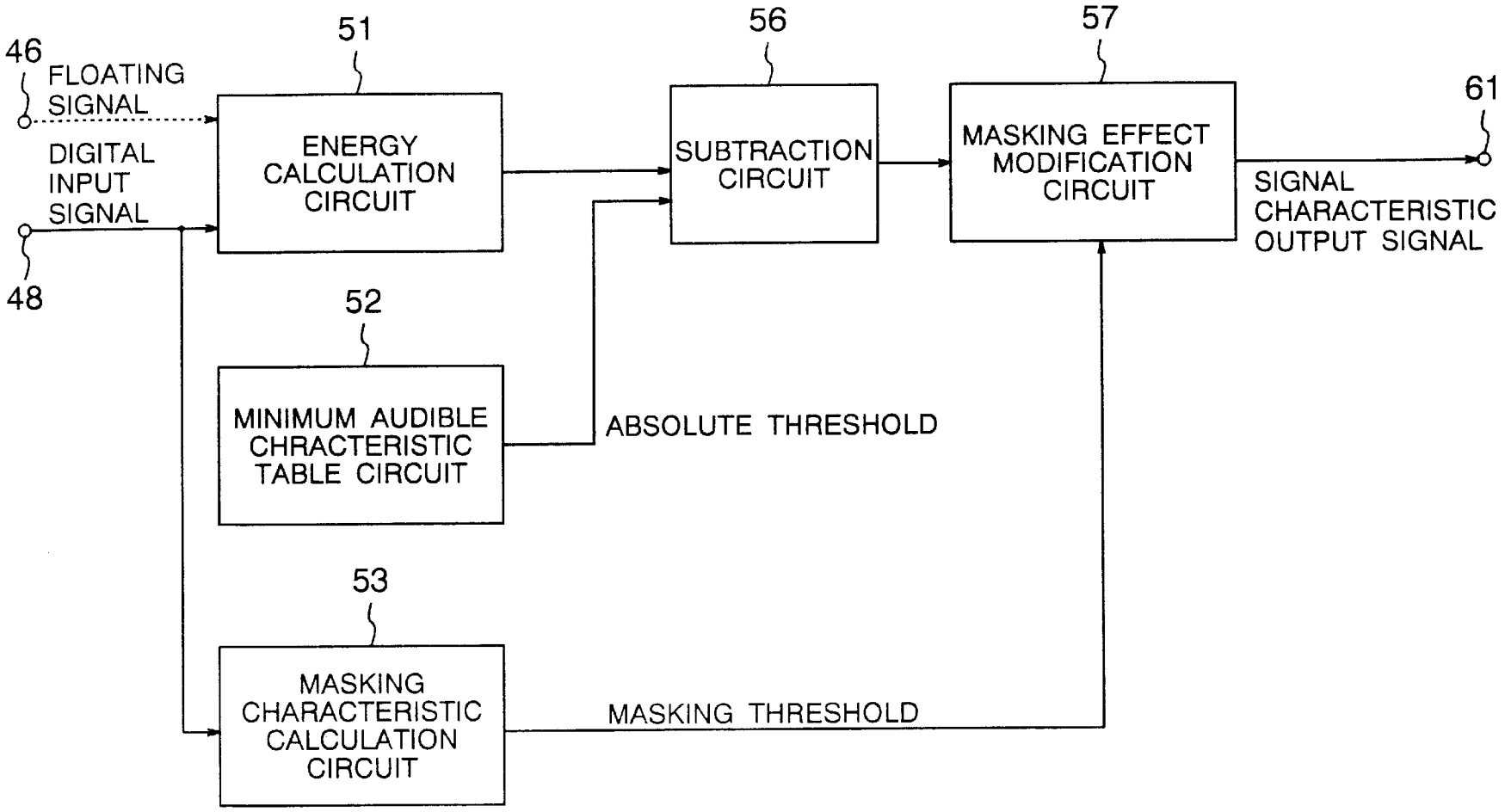
FIG. 8 PRIOR ART
FIG. 8 shows a block diagram of a configuration of a prior art signal characteristic calculation device.

Referring to FIGS. 4 and 5, the apparatus for compressing the audio data in accordance with a second embodiment of the present invention is explained. As shown in FIG. 4, the second embodiment is basically identical to the first embodiment shown in FIG. 1 except that the bit rate information is also applied to the signal characteristic calculation circuit 30A. The adaptive bit allocation circuit 31 may be identical to the circuit shown in FIG. 1 or it may use the prior art configuration shown in FIG. 7.

In the second embodiment, as shown in FIG. 4, the signal representing the bit rate applied to the terminal 11 is also applied to the signal characteristic calculation circuit 30A so that the signal characteristic calculation circuit 30A changes its process for signal characteristic calculation by the bit rate signal. Namely, when the bit rate is low, the permissible noise spectrum is calculated based on the masking effect and the minimum audible characteristic, and when the bit rate is high, the signal energy is calculated like the first embodiment.

Referring to FIG. 5, a specific configuration of the signal characteristic calculation circuit 30A is explained.

A switch control circuit 54 controls first and second switch circuits 55 and 58 in accordance with the bit rate based on the bit rate information applied to the input terminal 21.

For example, when the bit rate permitted to the audio signal is not lower than 128 KBPS (kilo bits per second), or when, in a stereo signal having two left and right channels, the bit rate permitted to one channel is not lower than 128 KBPS, the first switch circuit 55 is deactivated and the second switch circuit 58 is switched to the output of the energy calculation circuit 51.

When the bit rate is lower than 128 KBPS, the first switch circuit 55 is activated and the second switch circuit 58 is switched to the output of the masking effect correction circuit 57.

The digital input data is applied through the input terminal 48 of the signal characteristic calculation circuit 30A to the energy calculation circuit 51 for calculating the energy for each band shown in FIG. 5. Like the process in the filter bank circuit, the input audio digital signal is transformed into signals of a plurality of frequency bands, and for the audio signal contained in each band, the root-square-mean of the amplitude is calculated to obtain the energy. A peak amplitude may be used instead of the above energy value. Alternatively the floating information outputted from the output terminal 45 may be used for this purpose.

For example, when the bit rate is lower than 128 KBPS per channel, the permissible noise spectrum is determined based on the signal energy like the first embodiment. In the subtraction circuit 56, the absolute threshold corresponding to the minimum human audible characteristic which is the output from the minimum audible characteristic table 52 is subtracted from the signal energy for each band which is the output of the energy calculation circuit 51.

In the masking effect modification circuit 57, the masking effect of the permissible noise spectrum is modified. The characteristic signal which is the signal energy less the permissible noise spectrum is outputted to the adaptive bit allocation circuit 31 through the output terminal 61 of the signal characteristic calculation circuit.

When the bit rate is not lower than 128 KBPS per channel, the energy for each frequency band which is the output of the energy calculation circuit 51, is outputted to the adaptive bit allocation circuit 31 through the output terminal 61 of the signal characteristic calculation circuit 30A.

As the input signal to the signal characteristic calculation circuit, either the audio signals as transformed into the plurality of bands by the filter bank circuit 21 or the floating signals used in the floating circuits 22~25 may be used.

In the apparatus for compressing the audio signal of the present embodiment, when the bit rate is high, that is, when the compression factor is low, the quantization noise for each band is minimized by the bit allocation using the signal energy to attain high quality of sound, and the amount of calculation can be significantly reduced because the subtraction of the minimum audible characteristic and the correction of the masking effect can be omitted.

As described above, in accordance with the present embodiment, the signal characteristic to be used for the bit allocation of the digital input signal is changed in accordance with the bit rate such that when the bit rate is low, the bits are distributed by using the permissible noise spectrum based on the audible characteristic and when the bit rate is high and the compression factor is not very high, the bits are distributed to minimize the quantization noise energy of each band by using the signal energy. In this manner, high quality sound is provided and the amount of calculation for high bit rate is significantly reduced.

What is claimed is:

1. An apparatus for compressing audio data comprising:

means for sampling an input digital audio signal at a predetermined sampling period and dividing the sampled digital audio signal into divided digital audio signals in a plurality of frequency bands;

means, provided for each of said plurality of frequency bands, for applying a predetermined process to each one of the respective divided digital audio signals;

a calculating circuit for calculating a selected characteristic value for each of the divided digital audio signals after the predetermined process; and an adaptive bit allocation circuit for repeatedly allocating a number of bits to each of the divided digital audio signals on the basis of the characteristic value calculated by said calculating circuit and a bit rate of the input digital audio signal;

said adaptive bit allocation circuit including detection means for detecting one of said plurality of frequency bands containing one of the divided digital audio signals having a maximum characteristic value within a selected frequency range, bit allocation means for repeatedly allocating a unit number of bits to said one of the divided digital audio signals, modifying means for modifying the characteristic value on the basis of said unit number of bits used by said bit allocation means, counter means for counting a number of times of repetition by said bit allocation means, and detection range control means for selecting said frequency range to be used by said detection means in accordance with the bit rate of the input digital audio signal and an output of said counter means.

2. An apparatus for compressing audio data according to claim 1 wherein said calculation circuit includes a first circuit for calculating the characteristic value in accordance with a first predetermined process, a second circuit for calculating the characteristic value in accordance with a second predetermined process and switching means for selectively activating said first circuit and said second circuit in accordance with said bit rate of the input digital audio signal.

3. An apparatus for compressing audio data according to claim 2 wherein said first circuit calculates the characteristic value based on an energy value of each of the divided digital audio signals and said second circuit calculates the characteristic value based on a permissible noise spectrum of each of the divided digital audio signals.

4. An apparatus for compressing audio data comprising:

means for sampling an input digital audio signal at a predetermined sampling period and transforming the sampled digital audio signal into audio signals of a plurality of frequency bands;

means provided for each of the frequency bands for applying a predetermined process to the audio signal contained in the corresponding band;

means for calculating a signal characteristic for each of the audio signals contained in each of the frequency bands; and an adaptive bit allocation circuit for allocating to the respective bands bits to be used to represent each of the processed audio signals contained in each of the frequency bands based on a predetermined bit rate;

said signal characteristic calculation circuit including a first circuit for calculating the signal characteristic in accordance with a first predetermined process, a second circuit for calculating the signal characteristic in accordance with a second predetermined process and switching means for selectively activating said first circuit and said second circuit in accordance with said bit rate.

5. An apparatus for compressing audio data according to claim 4 wherein said first circuit calculates the signal characteristic based on an energy value of the audio signal and said second circuit calculates the signal characteristic based on a permissible noise spectrum of the audio signal.

6. An adaptive bit allocation circuit to be used in an apparatus for compressing an input digital audio signal by sampling the input digital audio signal at a predetermined sampling period and dividing the sampled digital audio signal into divided digital audio signals in a plurality of frequency bands and calculating a selected characteristic value for each of the divided digital audio signals, said adaptive bit allocation circuit comprising:

detection means for detecting one of said plurality of frequency bands containing one of the divided digital audio signals having a maximum characteristic value within a selected frequency range;

bit allocation means for repeatedly allocating a unit number of bits to said one of the divided digital audio signals;

modifying means for modifying the characteristic value on the basis of said unit number of bits used by said bit allocation means;

counter means for counting a number of times of repetition by said bit allocation means; and detection range control means for selecting said frequency range to be used by said detection means in accordance with the bit rate of the input digital audio signal and an output of said counter means.

* * * * *